US007183721B2

(12) United States Patent
Haque

(10) Patent No.: US 7,183,721 B2
(45) Date of Patent: Feb. 27, 2007

(54) BALLAST WITH CIRCUIT FOR DETECTING AND ELIMINATING AN ARC CONDITION

(75) Inventor: Ahteshamul Haque, Gurgaon (IN)

(73) Assignee: Osram Sylvania, Inc., Danvers, MA (US)

( * ) Notice: Subject to any disclaimer, the term of this patent is extended or adjusted under 35 U.S.C. 154(b) by 99 days.

(21) Appl. No.: 11/172,082

(22) Filed: Jun. 30, 2005

(65) Prior Publication Data

US 2005/0218831 A1 Oct. 6, 2005

(51) Int. Cl.
*H05B 37/02* (2006.01)

(52) U.S. Cl. ..... 315/209 R; 315/291; 315/DIG. 7

(58) Field of Classification Search ..... 315/209 R, 315/209 T, 209 CD, 227 R, 244, 245, 291, 315/DIG. 7; 361/2
See application file for complete search history.

(56) References Cited

U.S. PATENT DOCUMENTS

| | | | | |
|---|---|---|---|---|
| 4,488,199 A | 12/1984 | Bloomer | 361/93 |
| 5,619,105 A | 4/1997 | Holmquest | 315/225 |
| 5,952,794 A * | 9/1999 | Bergman et al. | 315/307 |
| 5,969,483 A * | 10/1999 | Li et al. | 315/225 |
| 6,128,169 A * | 10/2000 | Neiger et al. | 361/42 |
| 6,720,739 B2 | 4/2004 | Konopka | 315/225 |
| 6,809,483 B2 * | 10/2004 | Alexandrov | 315/224 |
| 6,946,807 B2 * | 9/2005 | Okamoto et al. | 315/291 |
| 2005/0046357 A1 | 3/2005 | Stack | 315/119 |

* cited by examiner

*Primary Examiner*—Thuy Vinh Tran
(74) *Attorney, Agent, or Firm*—Fitch, Even, Tabin & Flannery

(57) ABSTRACT

An apparatus for powering a lamp connected to a ballast circuit. A DC bus provides a DC voltage signal to an inverter. A control circuit selectively energizes the inverter to generate an AC signal for powering the lamp load via the rectifier circuit and an inverter circuit. A detection circuit connected between the lamp and inverter generates a detection signal indicating whether an arc condition is present in the circuit. The detection circuit also senses the magnitude of the detection signal and generates a command signal to provide to the control circuit to inhibit power from being supplied to the lamp during an arc condition. A switching circuit is coupled between the output of the detection circuit and circuit ground and responsive to an ignition signal from the control circuit to direct the detection signal to ground during an ignition period.

16 Claims, 3 Drawing Sheets

BALLAST WITH CIRCUIT FOR DETECTING AND ELIMINATING AN ARC CONDITION

TECHNICAL FIELD

The present invention relates to ballast systems. In particular, the invention relates to a ballast that includes circuitry for de-energizing the ballast in response to a detected arc condition.

BACKGROUND OF THE INVENTION

Fluorescent lamps (also known as gas discharge lamps) economically illuminate an area. Due to the unique operating characteristics of fluorescent lamps, the lamps must be powered by a ballast. Ballasts provide high ignition voltages for starting the lamps. For example, the ignition voltages supplied by preheat type ballasts are typically on the order of several hundred volts (e.g., 500 volts peak), while those provided by instant-start type ballasts may exceed 1000 volts peak. As a result of such high ignition voltages, arcing may occur during operation of ballasts. For example, an arc may form between a lamp holder contacts and a pin of the lamp when a lamp is being removed from the holder or inserted into the holder. According to ANSI/UL specifications, the duration an arc is present should be less than a specified time period. Thus, a need exists for a ballast having a detection circuit that readily detects an arc condition and that, in response to a detected arc condition, shuts down the ballast in order to eliminate the arc condition. However, during operation of an instant-start, or programme-start type ballast, there are high increases in ballast voltages and currents during normal ignition of lamp(s) which may appear as similar to an arc condition. To avoid shutting down the ballast during this normal operation, there is need for a ballast circuit that shuts down the ballast during an arc condition, but that does not shut down the ballast during an ignition period.

SUMMARY OF THE INVENTION

In accordance with one aspect of the invention, a ballast circuit is provided for powering a lamp. The ballast includes a direct current (DC) bus and an inverter circuit coupled between the DC bus and the lamp. A control circuit controls the inverter circuit to provide power to the lamp and initiates an ignition cycle when sensing a lamp connected to the inverter circuit. A detection circuit connected to the inverter circuit is responsive to the control circuit to detect a detection signal indicative of an arc. The detection circuit also generates a command signal to provide to the control circuit for inhibiting the control circuit from providing power to the lamp, except during the ignition cycle.

In accordance with another aspect of the invention, a detection circuit is provided for detecting an arc in a ballast circuit powering a lamp. The detection circuit includes a control circuit that controls an inverter circuit to provide an AC voltage signal to power the lamp and that initiates an ignition cycle when sensing a lamp connected to the inverter. A rectifier circuit coupled to the inverter circuit generates a DC voltage signal. A filter circuit coupled to the rectifier circuit is responsive to the DC voltage signal to generate a detection signal. The detection signal has a first magnitude during normal operation of the lamp and has a second magnitude during an arc. A sensing circuit connected to the filter circuit is responsive to the detection signal to generate a command signal to provide the control circuit for inhibiting, except during the ignition cycle, the control circuit from providing power to the lamp when the detection signal has the second magnitude.

Alternatively, the invention may comprise various other apparatuses.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
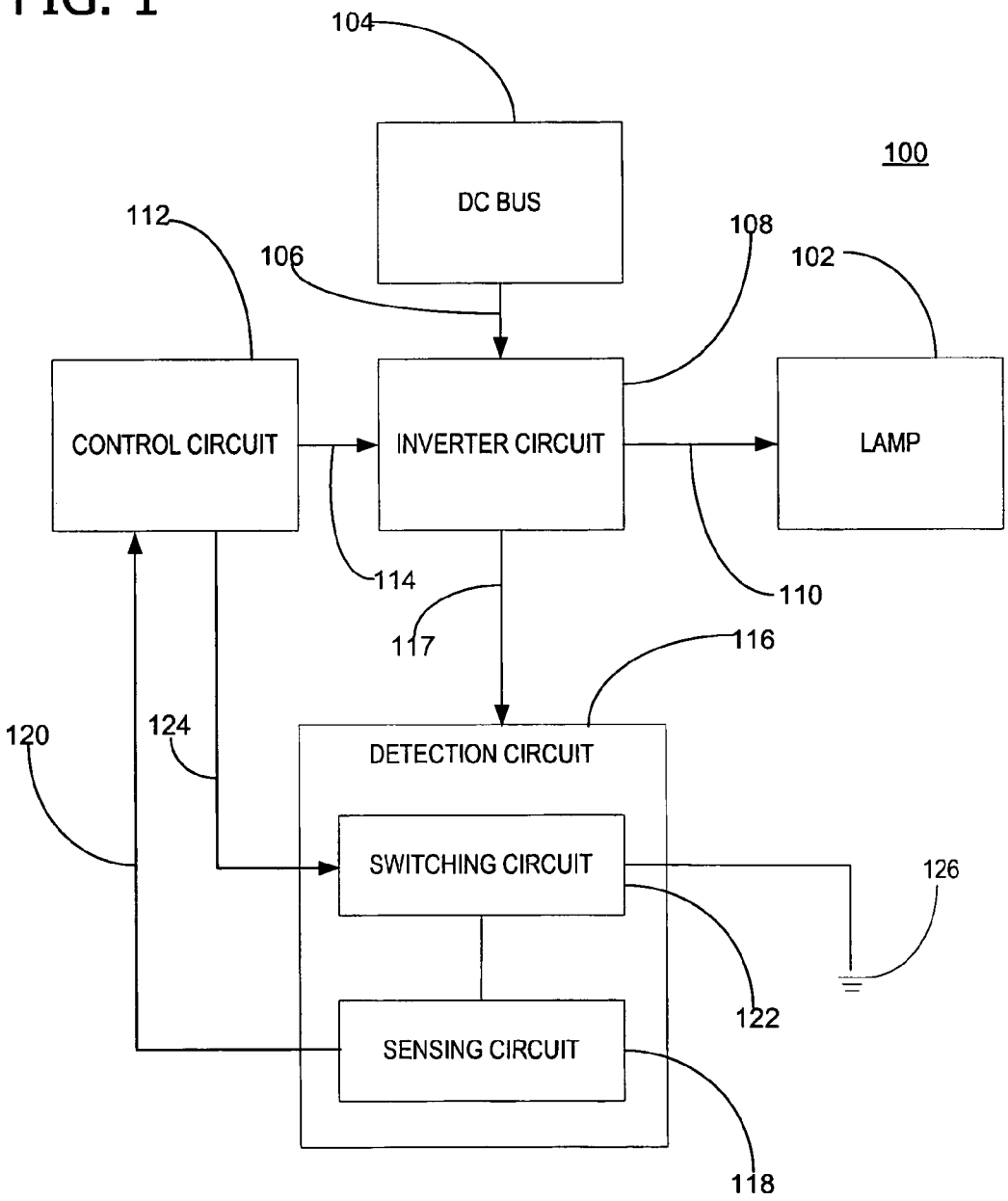
FIG. 1 is a block diagram illustrating components of a ballast circuit for powering a lamp 102 according to one embodiment of the invention.

FIG. 1 is a block diagram illustrating components of a ballast circuit 100 for powering a lamp 102. The ballast circuit 100 includes a DC bus 104 for connection to a DC source (not shown) such as a rectified input AC source, a battery, or any other source of DC power. The DC bus 104 supplies an input DC voltage signal 106 to an inverter circuit 108. The inverter circuit 108 coupled between the DC bus 104 and the lamp 102 converts the input DC voltage signal 106 into an output AC voltage signal 110 for powering the lamp 102. The inverter circuit 108 is coupled to a control circuit 112 that supplies a control signal 114. The inverter circuit 108 is responsive to the control signal 114 and to the input DC voltage signal 106 to generate the output AC voltage signal 110 for powering the lamp 102.

According to the present invention, a detection circuit 116 is coupled to the inverter circuit 108 for detecting a detection signal 117 within the ballast circuit 100 indicative of an arc. More specifically, the detection circuit 116 includes a sensing circuit 118 for sensing a magnitude of a parameter of the detection signal 117 at a particular sensing point (e.g., filtering resistor 310; see FIG. 3) within the circuit 100, and for generating a command signal 120, as a function of the magnitude of the sensed parameter, that is provided to the control circuit 112. As explained in more detail below in reference to FIG. 3, the sensed parameter of the detection signal 117 is a voltage corresponding to a high frequency current signal indicative of an arc. For example, if the magnitude of the sensed voltage exceeds a threshold value, the sensing circuit 118 generates the command signal 120. The control circuit 112 is responsive to the command signal 120 to produce a control signal 114 that inhibits operation of the inverter circuit 108, and, thus inhibits AC power from being supplied to the lamp 102 so that any arcing is eliminated. For instance, when a lamp is inserted into the holder an arc can form between the holder sockets and the pins of the lamp. This arc induces a short duration high frequency rise in the current. As explained in more detail in reference to FIG. 3, below, when this high frequency rise in current occurs, the sensing circuit 118 generates the command signal 120, and the control circuit 112 inhibits operation of the inverter circuit 108, which shuts down the ballast circuit 100. Notably, it is contemplated that the detection signal 117 may be a voltage of a sensed signal, a current of a sensed signal, a frequency of a sensed signal, a combination thereof or any other parameter.

Although the above sensing circuit 118 eliminates arcing, it can also operate to interfere with normal ignition of the lamp 102. To prevent the control circuit 112 from shutting down the ballast circuit 100 during ignition of the lamp 102, a switching circuit 122 responsive to an ignition signal 124 generated by the control circuit 112 disables the sensing circuit 118 during an ignition cycle. As used herein, the ignition cycle corresponds to a period of time required for igniting the lamp 102 after power is applied to the circuit 100. When power is applied to the circuit 100, current flows in the circuit 100. The control circuit 112 is responsive to the current flow to supply the ignition signal 124 to the switching circuit 122 for a predetermined period of time. As the inverter circuit 108 begins to operate and subsequently attempts to ignite the lamp 102, those events may cause the detection circuit 116 to generate a command signal 120 indicative of an arc. The switching circuit 122 is responsive to the ignition signal 124 received from the control circuit 112 during the ignition period for disabling the sensing circuit 118 when the control circuit 112 initiates the ignition cycle, such as by connecting the detection signal to ground 126 (as illustrated in FIG. 3).

Figure 2:
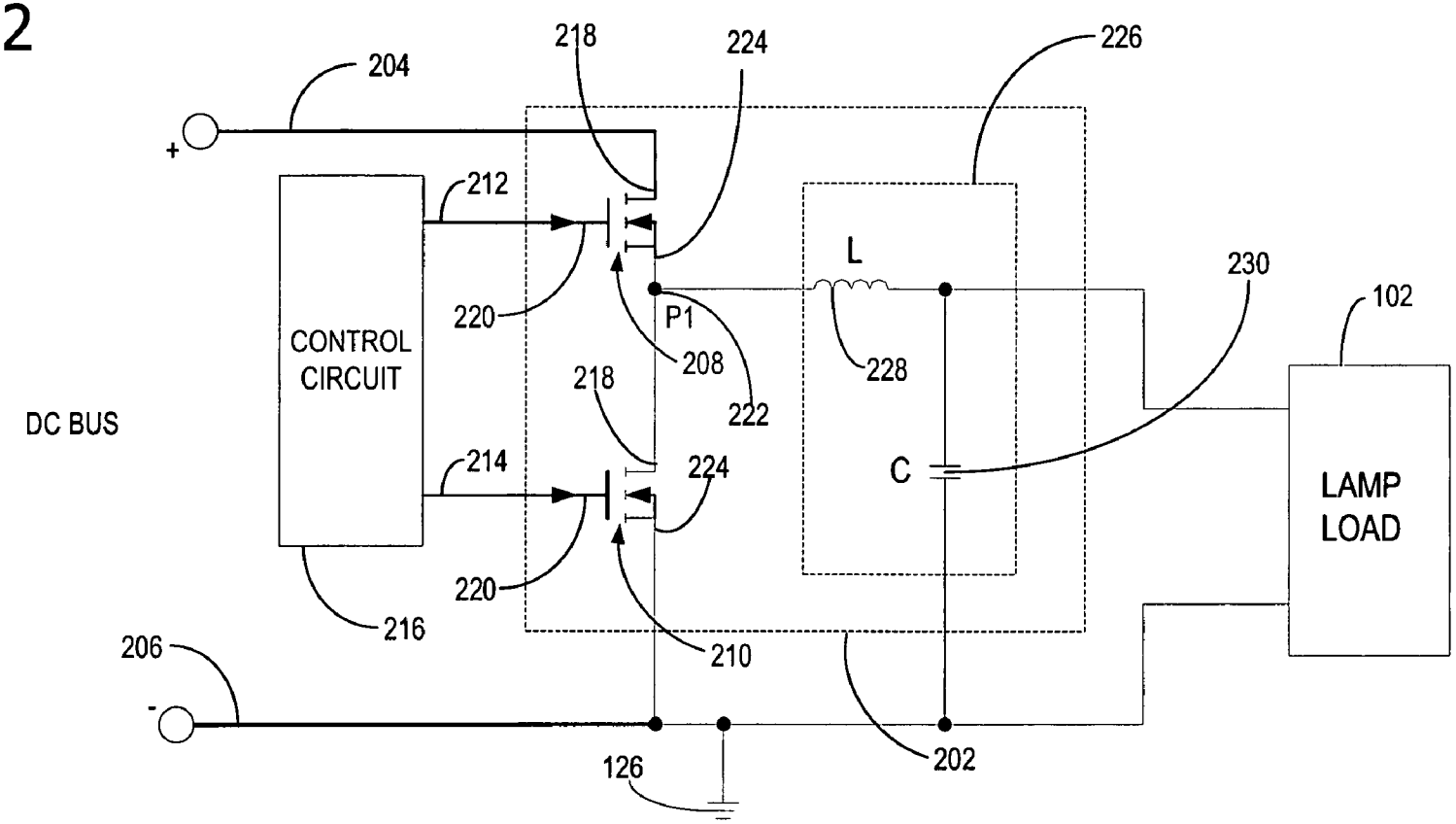
FIG. 2 illustrates components of an inverter circuit used for converting a DC signal into an AC signal for powering the lamp according to one embodiment of the invention.

Referring now to FIG. 2, a schematic diagram illustrates components of an inverter circuit 202 (e.g., inverter circuit 108) used for converting a DC voltage signal into an AC voltage signal for powering the lamp 102 according to one embodiment of the invention. An input DC voltage signal 106, as described above in reference to FIG. 1, is supplied to the inverter circuit 202 via DC bus terminals 204, 206. In this embodiment, the inverter circuit 202 includes switching transistors 208, 210, such as MOSFETs, connected between DC bus terminals 204, 206. MOSFETs 208, 210 are driven by first and second control signals 212, 214, respectively, supplied from a control circuit 216 (e.g., control circuit 112) to generate the output AC voltage signal 110. The control circuit 216 can be a L6569 Half Bridge Driver manufactured by STMicroelectronics of Plan les Ouates, Geneva, Switzerland. A drain 218 of the MOSFET 208 is coupled to DC bus terminal 204. A gate 220 of the MOSFET 208 is connected to the control circuit 216 and responsive to the first control signal 212 generated by the control circuit 216 to turn the MOSFET 208 on and off. For example, when the magnitude of the first control signal 212 is equal to or greater than a threshold voltage (i.e., when the first control signal has at least a minimum magnitude), the MOSFET 208 turns on and positive current flows through the MOSFET 208 (i.e., current flows into the drain 218 and out of the source 224, to a point P1, as indicated by 222). A drain 218 of the MOSFET 210 is coupled to a source 224 of MOSFET 208. A gate 220 of the MOSFET 210 is connected to the control circuit 216 and responsive to the second control signal 214 generated by the control circuit 216 to turn the MOSFET 210 on and off. For example, when the magnitude of the second control signal 214 is equal to or greater than a threshold voltage (i.e., when the second control signal has a maximum magnitude), the MOSFET 210 turns on and positive current flows through the MOSFET 210 (i.e., current flows from point P1 222, into the drain 218, and out of the source 224 to circuit ground 126). By activating MOSFETs 208, 210 in an alternating fashion, the controller 220 causes the inverter circuit 202 to generate an output AC signal (preferably, having a frequency in excess of 20,000 hertz) to operate the lamp 102.

A resonant tank circuit 226 is connected to the MOSFETS 208,210 at connection point P1 222, located between the source 224 of MOSFET 208 and the drain 218 of MOSFET 210, and to circuit ground 126. The resonant tank circuit 226 includes a resonant inductor 228 connected in series with a resonant capacitor 230. The lamp load 102 is connected in parallel with resonant capacitor 230.

Figure 3:
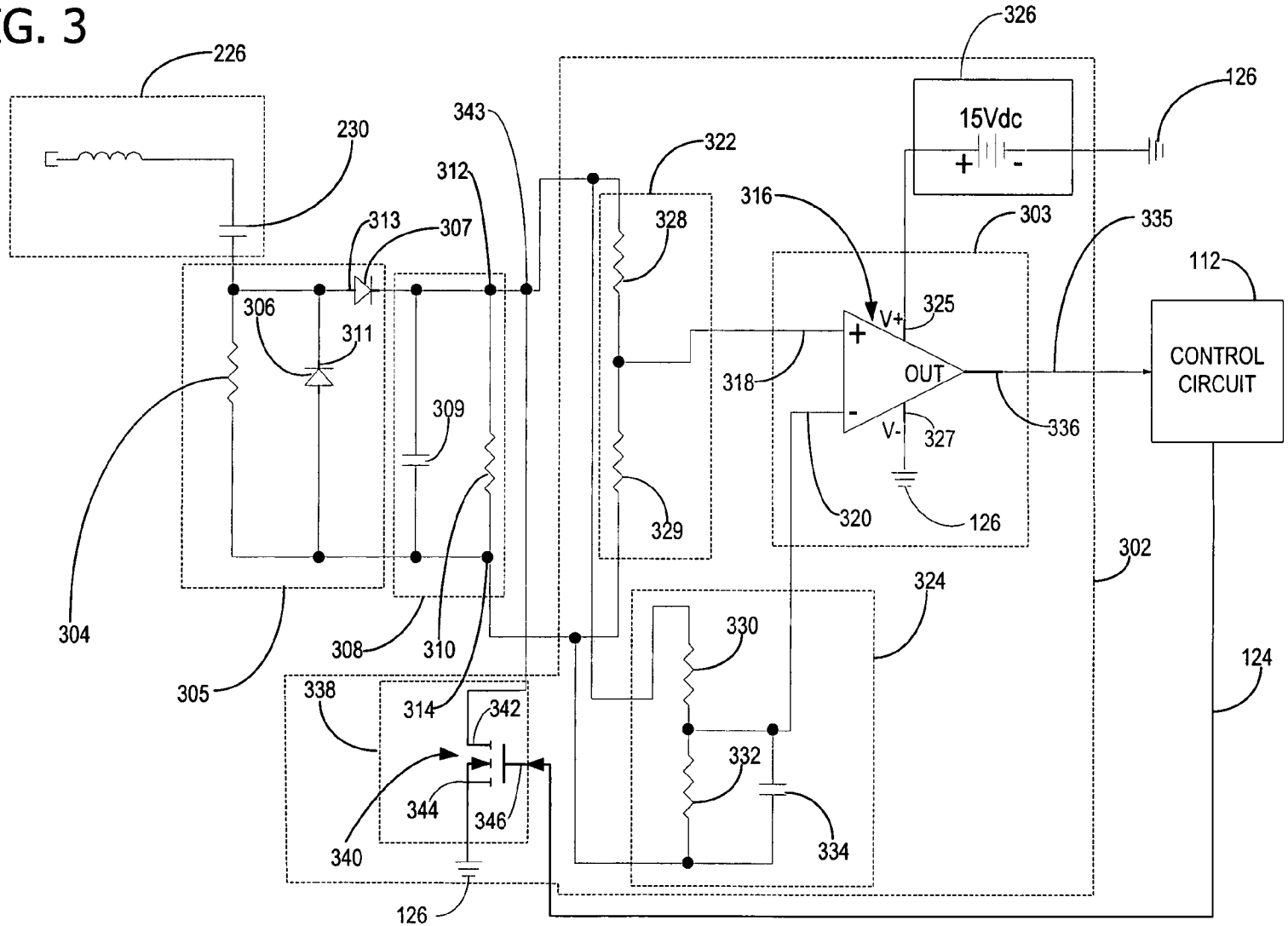
FIG. 3 illustrates components of a detection circuit for detecting an arc condition in the ballast according to one embodiment of the invention.

Referring now to FIG. 3, a schematic diagram illustrates components of a detection circuit 302 (e.g., detection circuit 116) for detecting an arc condition in a ballast circuit 100 according to one embodiment of the invention. As described above, the detection circuit 302 includes a sensing circuit 303 (e.g., sensing circuit 118) for sensing a magnitude of a parameter of a detection signal generated within the ballast circuit 100, and for generating the command signal 120 provided to the control circuit 112 as a function of the magnitude of the sensed parameter. In this particular embodiment, a resistor 304 is connected in series with the resonant capacitor 230. A rectifier circuit 305 comprising first and second diodes 306, 307 converts an AC voltage signal produced across resistor 304 into a DC voltage signal. An RC filter 308 comprising a filtering capacitor 309 and filtering resistor 310 receives the DC voltage signal and outputs a filtered DC voltage signal. The filtering capacitor 309 is connected between a cathode 311 of the first diode 306 and an anode 313 of second diode 307. The filtering resistor 310 is connected in parallel with the filtering capacitor 309. When an arc condition occurs in the circuit (e.g., lamp pins are being removed from the lamp holder sockets), the frequency of the current flowing in the ballast circuit 100 increases from an initial frequency, corresponding to normal circuit operation, to a higher frequency corresponding to an arc condition. Although this increase in frequency of the current only occurs for a brief period of time, a voltage is produced across resistor 304 that is rectified by diode 307, and filtered by the RC filter 308 to generate a filtered DC voltage between terminals 312 and 314. The detection signal (e.g., detection signal 117 in FIG. 1) sensed by the sensing circuit 303 corresponds to this filtered DC voltage. In an alternative embodiment, it is contemplated that the detection signal may correspond to a sensed current flowing through the filtering resistor 310, and/or the sensed frequency of current flowing through resistor 304.

In this embodiment, the sensing circuit 303 includes an operational amplifier (opamp) 316 having a first input terminal (non-inverting terminal) 318 and a second input terminal 320 (inverting terminal). The non-inverting terminal 318 is connected to the output of the RC filter 308 via a first voltage divider network 322, and the inverting terminal 320 is connected to the output of the RC filter 308 via a second voltage divider network 324. The opamp 316 includes a positive voltage input 325 connected to a DC voltage source 326 (e.g., 15 volt DC source), and a negative voltage input 327 connected to ground 126. The first voltage divider network 322 comprises resistors 328, 329 connected in series with each other and connected in parallel with the filtering resistor 310. The non-inverting input terminal 318 connected between resistors 328, 329 receives an input voltage that is determined as function of the resistance values of resistors 328, 329, and the filtered DC voltage signal output from the RC filter 308. The second voltage divider network 324 comprises resistors 330, 332 connected in series with each other and connected in parallel with filtering resistor 310, and a delay capacitor 334 connected in parallel with resistor 332. The inverting input terminal 320 connected to the delay capacitor 334 receives an input voltage determined as function of the resistance values of resistors 330, 332, the filtered DC voltage signal output from the RC filter 308, and a charging, or delay, time associated with charging the delay capacitor 334. The resistance values of resistors are 328, 329 are equivalent to the resistance values of resistors 330, 332, respectively. As a result, when a DC voltage is produced across the filtering resistor 310, there is a lag time, which corresponds to the charging characteristics of the delay capacitor 334, during which time the input voltage being supplied to the non-inverting input terminal 318 is greater than input voltage being supplied to the inverting input terminal 320. Thus, when the DC voltage across the filtering resistor 310 increases, the input voltage at the non-inverting input terminal 318 increases immediately. However, when the DC voltage across the filtering resistor 310 increases, the input voltage at the inverting input terminal 320 increases at a slower rate due to the time required for the delay capacitor 334 to completely charge. The opamp 316 is responsive to the difference in the input voltages at the non-inverting input terminal 318 and the inverting input terminal 320 to generate an output voltage signal, as indicated by reference character 335.

In one embodiment, the opamp 316 is configured to operate as a comparator and generates and the output voltage signal 335 (i.e., command signal 120) as a function of the difference between the input voltage being supplied to the non-inverting terminal 318, the input voltage being supplied to the inverting terminal 320, and a reference voltage (e.g., 15 Vdc) being applied to the opamp 316. As known to those skilled in the art, the following equation can be used to calculate the output voltage ($V_{out}$) generated by the opamp 316:

$$V\ out = V_{ref}(V_{non\text{-}inv} - V_{inv}); \quad (1)$$

where $V_{ref}$ is a reference voltage applied to the opamp, $V_{non\text{-}inv}$ is the input voltage being supplied to the non-inverting input terminal 318, and $V_{inv}$ is to the input voltage being supplied to the inverting input terminal 320.

Thus, during normal operation of the ballast circuit 100 (i.e., after lamp ignition and with no arc condition present), substantially the same input voltages are supplied to the non-inverting input terminal 318 and the inverting input terminal 320, and the opamp 316 generates an output signal (i.e., command signal 120) having a minimum magnitude (e.g., zero (0) volts). However, during an arc condition (e.g., when a lamp is removed during a normal running condition), the DC voltage across the filtering resistor 310 increases, causing the input voltage being supplied the non-inverting input terminal 318 to increase. However, as explained above, due to the delay capacitor 334, the input voltage being supplied the inverting input terminal 320 increases after a lag time. Thus, during an arc condition, the input voltage supplied to the non-inverting input terminal 318 is greater than the input voltage supplied to inverting input terminal 320, and the opamp 316 generates a command signal having a maximum magnitude (e.g., greater than (0) volts).

The control circuit 112 is coupled to an output terminal 336 of the opamp 316 to receive the generated output voltage signal 335. The control circuit 112 is responsive to an output voltage signal 335 having a magnitude, which is indicative of an arc, to deactivate the MOSFETs 208, 210 (See FIG. 2) which inhibits power from being supplied to the lamp 102. As described above, an arc condition may be detected by the sensing circuit 304 during an ignition period after the lamp 102 is connected to the circuit 100. As known to those skilled in the art, during ignition of preheat and instant start type ballasts, high ignition voltages (e.g., 500 volts or more) are supplied to start (i.e., preheat) the lamp 102. This increase in voltage (e.g., from 0 volt to 500 volts) in the circuit 100 when starting the lamp 102 causes the opamp 316 to generate an output voltage signal 335 indicative of an arc. In other words, the input voltage being supplied to the non-inverting input terminal 318 may be greater than the input voltage supplied to inverting input terminal 320 during the ignition period. However, because it is not desirable to shut down the ballast circuit 100 during the ignition period, the detection circuit 302 includes a switching circuit 338 for directing or shorting the filtered DC voltage (i.e., detection signal 117) to ground 126 during the ignition period.

In one embodiment, the switching circuit 338 includes a MOSFET 340 having a drain 342 connected to a connection point 343, a source 344 connected to circuit ground 126, and a gate 346 connected to the control circuit 112. The MOSFET 340 is responsive to an ignition signal 124 from the control circuit 112 to selectively connect the connection point 343 to ground 126. As explained above in reference to FIG. 1, the control circuit 112 is responsive to an input signal representative of a change in current flow to supply the ignition signal 124 to the switching circuit 338 for a predetermined period of time. In this case, the ignition signal 124 corresponds to a voltage signal that is applied to the gate 346 of the MOSFET 340 to turn on the MOSFTET 340. When the MOSFET 340 turns on, connection point 343 is connected to ground 126, and, thus, both input voltages supplied to the inverting and non-inverting input terminals 318, 320, are pulled down to zero (0) volts. In other words, the switching circuit 122 is responsive to the ignition signal 124 received from the control circuit during the ignition period, to direct the detection signal to ground 126.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

I claim:

1. A ballast circuit for powering a lamp, said circuit comprising:

a direct current (DC) bus;

an inverter circuit coupled between the DC bus and the lamp;

a control circuit for controlling the inverter circuit to provide power to the lamp and for initiating an ignition cycle in order to ignite the lamp; and a detection circuit connected to the inverter circuit and responsive to the control circuit for detecting a detection signal indicative of an arc, and for generating a command signal provided to the control circuit for inhibiting the control circuit from providing power to the lamp, the detection circuit comprising:

a sensing circuit connected to the inverter circuit for sensing a magnitude of the detection signal, wherein the magnitude is indicative of an arc, and generating the command signal to be provided to the control circuit for inhibiting the control circuit from providing power to the lamp when the magnitude of the detection signal exceeds a threshold value; and a switching circuit responsive to the control circuit and coupled to the sensing circuit for disabling the sensing circuit when the control circuit initiates the ignition cycle.

2. The circuit of claim 1, wherein the switching circuit is further coupled to a circuit ground and is responsive to the control circuit to selectively connect the detection signal to the circuit ground during the ignition cycle.

3. The circuit of claim 1, wherein the detection signal has a first frequency during a normal operating condition and a second frequency during an arc condition, and wherein the detection circuit generates the command signal when the detection signal has the second frequency.

4. The circuit of claim 1, wherein the detection signal is a current signal indicative of current supplied to the lamp, and wherein the detection circuit generates the command signal when the current signal represents a high frequency current indicative of an arc.

5. The circuit of claim 1, wherein the inverter circuit includes:

an inverter coupled to the control circuit and the DC bus, and responsive to the control circuit for inverting a DC signal received from the DC bus into alternating current (AC) signal; and a resonant tank coupled between the inverter and the lamp to produce an output AC signal for powering the lamp.

6. The circuit of claim 5, wherein the resonant tank comprises a resonant inductor and a resonant capacitor connected in series.

7. The circuit of claim 5, further comprising:

a rectifier circuit coupled to the resonant tank for generating a DC output signal; and a filter circuit coupled to the rectifier circuit and responsive to the DC output signal to generate the detection signal provided to the detection circuit, wherein the detection signal has a first magnitude during normal operation of the lamp and has a second magnitude during an arc.

8. The circuit of claim 7, wherein the detection circuit generates a command signal having a first state when the detection signal has the first magnitude, and generates a command signal having a second state when the detection signal has the second magnitude, and wherein the control circuit is responsive to the command signal having the second state to inhibit the control circuit from providing power to the lamp except during the ignition cycle.

9. The circuit of claim 8, wherein the detection circuit includes an operational amplifier having first and second input terminals, wherein the first input terminal is connected to the filter circuit for receiving a first input voltage and the second input terminal is connected to the filter circuit via a delay capacitor for receiving a second input voltage, wherein said operating amplifier generates the command signal having the first state when the magnitudes of the first and second input voltages are substantially the same in magnitude, and wherein said operating amplifier generates the command signal having the second state when the magnitudes of the first and second input voltages are substantially different in magnitude.

10. The circuit of claim 1, wherein the detection signal corresponds to a detected voltage signal indicative of an arc, and wherein the detection circuit generates the command signal as a function of a magnitude of the detected voltage signal.

11. A detection circuit for detecting an arc in a ballast circuit powering a lamp:

a control circuit for controlling an inverter circuit to provide an AC voltage signal to power the lamp and for initiating an ignition cycle when sensing a lamp connected to the inverter;

a rectifier circuit coupled to the inverter circuit for generating a DC voltage signal;

a filter circuit coupled to the rectifier circuit and responsive to the DC voltage signal to generate a detection signal, wherein the detection signal has a first magnitude during normal operation of the lamp and has a second magnitude during an arc; and a sensing circuit connected to the filter circuit and responsive to the detection signal for generating a command signal provided to the control circuit for inhibiting, except during the ignition cycle, the control circuit from providing power to the lamp when the detection signal has the second magnitude.

12. The detection circuit of claim 11, further including a switching circuit responsive to the control circuit and coupled to the sensing circuit for disabling the sensing circuit when the control circuit initiates an ignition cycle.

13. The detection circuit of claim 12, wherein the switching circuit is further coupled to a circuit ground and responsive to the control circuit to selectively provide the detection signal to the circuit ground during the ignition cycle.

14. The detection circuit of claim 11, wherein the sensing circuit generates a command signal having a first state when the detection signal has the first magnitude, and wherein the sensing circuit generates a command signal having a second state when the detection signal has the second magnitude, and wherein the control circuit is responsive to the command signal having the second state to inhibit the control circuit from providing power to the lamp.

15. The detection circuit of claim 11, wherein the detection signal corresponds to a detected voltage signal indicative of an arc, and wherein the sensing circuit senses the magnitude of the detected voltage signal and generates the command signal to inhibit the control circuit from providing power to the lamp when the magnitude of the detected voltage signal exceeds a threshold value.

16. The detection circuit of claim 11, wherein the sensing circuit includes an operational amplifier having first and second input terminals, wherein the first input terminal is connected to the filter circuit for receiving a first input voltage and the second input terminal is connected to the filter circuit via a delay capacitor for receiving a second input voltage, wherein said operating amplifier generates the command signal having the first state when the magnitudes of the first and second input voltages are substantially the same in magnitude, and wherein said operating amplifier generates the command signal having the second state when the magnitudes of the first and second input voltages are substantially different in magnitude.

* * * * *